US008397453B2

(12) United States Patent
Shaw

(10) Patent No.: US 8,397,453 B2
(45) Date of Patent: Mar. 19, 2013

(54) MOISTURE IMPERMEABLE FIRE-BARRIERS

(75) Inventor: Alan Shaw, Lockport, NY (US)

(73) Assignee: Fireline 520, LLC, Buffalo, NY (US)

( * ) Notice: Subject to any disclaimer, the term of this patent is extended or adjusted under 35 U.S.C. 154(b) by 0 days.

(21) Appl. No.: 13/437,619

(22) Filed: Apr. 2, 2012

(65) Prior Publication Data

US 2012/0198784 A1 Aug. 9, 2012

Related U.S. Application Data

(63) Continuation-in-part of application No. 12/693,083, filed on Jan. 25, 2010, now abandoned, which is a continuation-in-part of application No. 12/185,160, filed on Aug. 4, 2008, now abandoned.

(60) Provisional application No. 60/953,703, filed on Aug. 3, 2007.

(51) Int. Cl.

| | |
|---|---|
| ***E04C 2/00*** | (2006.01) |
| ***E04B 1/70*** | (2006.01) |
| ***E04B 1/66*** | (2006.01) |
| ***E04B 1/68*** | (2006.01) |

(52) U.S. Cl. ..... 52/232; 52/396.01; 52/302.6; 52/302.7; 52/309.1; 52/396.04

(58) Field of Classification Search ..... 52/232, 52/302.7, 396.01, 396.06, 302.3, 317, 396.02, 52/309.1, 273, 396.04, 408, 1, 239, 394, 52/393

See application file for complete search history.

(56) References Cited

U.S. PATENT DOCUMENTS

| | | | | |
|---|---|---|---|---|
| 4,517,779 | A * | 5/1985 | Dunsworth | 52/232 |
| 4,977,719 | A * | 12/1990 | LaRoche et al. | 52/396.01 |
| 6,368,670 | B1 * | 4/2002 | Frost et al. | 427/385.5 |
| 7,070,653 | B2 * | 7/2006 | Frost et al. | 118/300 |
| 2002/0113143 | A1 * | 8/2002 | Frost et al. | 239/337 |
| 2003/0211291 | A1 * | 11/2003 | Castiglione et al. | 428/172 |
| 2008/0127590 | A1 * | 6/2008 | Derrigan et al. | 52/395 |

FOREIGN PATENT DOCUMENTS

| | | | |
|---|---|---|---|
| JP | 2001115566 | * | 4/2001 |

* cited by examiner

*Primary Examiner* — Mark Wendell
(74) *Attorney, Agent, or Firm* — Patricia M. Costanzo

(57) ABSTRACT

An example of a pre-assembled, moisture, water, and gas impermeable fire-barrier system for use in expansion-joint spaces includes a fire-barrier having a layer of outermost protective cloth layer overlain by an insulation blanket overlain by stainless steel foil, overlain by a second insulation blanket, overlain by a limited layer of intumescent material, overlain by impermeable silicon coated cloth to completely or partially surround all of the other layers of the barrier. If desired, a first attachment apparatus for attaching a first long edge of the fire-barrier to a building unit and a second attachment apparatus for attaching the opposing second long edge to an opposing spaced building unit may be fixedly attached to the barrier. The barrier system may be fitted with a drain aperture and a drainage hose emanating from the aperture, the hose protected from the heat of a fire.

20 Claims, 7 Drawing Sheets

MOISTURE IMPERMEABLE FIRE-BARRIERS

CROSS-REFERENCE TO RELATED APPLICATIONS

This Continuation-in-Part application claims benefit to Continuation-In-Part patent application Ser. No. 12/693,083 filed Jan. 25, 2010 that claimed benefit to Non-Provisional patent application Ser. No. 12/185,160 filed Aug. 4, 2008 now abandoned and to Provisional Application No. 60/953,703 filed Aug. 3, 2007.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to fire-barriers and more particularly to moisture impermeable fire-barriers.

The background information discussed below is presented to better illustrate the novelty and usefulness of the present invention. This background information is not admitted prior art.

Modern building codes require that stresses experienced by buildings from extreme and/or repetitive changes in temperature, the force of high winds impinging on the building, multi-directional forces due to seismic events, settling of subsoil, building remodels, and excavation on or near the site, for example, must be taken into account in the building design. To accommodate these stresses, buildings must be constructed with a code-mandated space between adjacent wall, floor, and/or ceiling structures. These spaces, referred to as "expansion-joint spaces," allow differential building motions to take place without risking damage to the whole structure.

While expansion-joint spaces improve the life-time integrity of the structure, they also present a major fire risk to the structure. During a fire, the mandated expansion-joint spaces serve as chimney flues providing pathways for gases, flame, and smoke to spread rapidly throughout a structure. To counter the chimney flue effect, building codes for commercial and public structures require the installation of fire-barriers in the expansion-joint spaces. The fire-barriers are supposed to prevent or to reduce the rate of flames and smoke passing through the joints into adjoining areas of the building to extend the time available for inhabitants to leave the building and for fire fighters to get to the fire.

During their lifetime however, fire-barriers undergo various types of structural stress. For example, each time a structure is subjected to earthquake activity, ground settling, wind, or temperature contraction or expansion, the fire-barriers installed in the expansion-joint spaces also are subject to the forces of expansion and compression in a variety of directions. The ability of fire-barriers to maintain their integrity, after or while being stressed, is of course put to the ultimate test during a fire. When fire-barriers fail, loss of both life and property can result. This makes it essential to design and manufacture fire-barriers that can retain their integrity for their lifetime. Accordingly, fire-barriers are legally mandated to be tested, rated, and certified before being installed. There are two currently mandated tests. One measures the ability of a fire-barrier to maintain its structural integrity under compressional and tensional motion. This test is referred to as the "cycle" test and its parameters are specified by ASTM 1399. The other test is referred to as the "fire" or "burn" test and its parameters are specified by UL 2079. The two tests are conducted in sequence. A fire-barrier is first cycled between forces of compression and tension 500 times and then, if the barrier passes that test, it is placed into a furnace where it is tested for its ability to resist and prevents flame, heat, and gases from passing through the barrier. Fire-barriers that are sold as tested are assumed to be able to perform to the parameters tested.

The importance of correctly installing and maintaining tested and certified fire-barriers is increasingly recognized by building officials, owners, insurance companies, contractors, and the public. Once a fire-barrier passes any of the tests described above, the testing certification will hold only as long as the barrier remains unaltered. Thus, fire-barriers always should be manufactured exactly according to their testing certification requirements, in a testing agency approved facility, and by a testing agency approved method. Once manufactured according to testing agency requirement, the barriers are ready for installation as they are. That is, they should not be altered. The mission of the international non-profit National Fire Protection Agency (NFPA) is to reduce, worldwide, the burden of fire and other hazards on the quality of life by providing and advocating consensus codes and standards. See, for example, the 2009 edition of *NFPA* 221: *Standard for High Challenge Fire Walls, Fire Walls, and Fire-barrier Walls*).

Many states have adopted the NFPA Life Safety Code, which requires fire sprinklers in basements of all new schools and, with exceptions, in basements of existing schools. The International Building Code now mandates sprinkler systems in public buildings such as malls, entertainment areas, and stadiums, high rises, medical facilities, jails, and airplane hangers. Additionally, sprinklers are becoming required in schools and even in private homes. In states that do not have separate requirements for sprinklers in schools, laws or fire codes that require them in buildings above a certain seize or height would apply to schools that have these characteristics. many states have adopted the NFPA Life Safety Code, which requires fire sprinklers in basements of all new schools and, with exceptions, in basements of existing schools. Also, in some states, it is the local jurisdiction or school district, rather than state law that determines sprinkler requirements. Thus, although there may be no statewide requirement, there may be local requirements. In addition to developing standards for fire-barriers, NFPA has also developed NFPA 13: Standard for the Installation of Sprinkler Systems. Current Edition is 2010; Next Edition will be 2013. NFPA13. The requirements to install a sprinkler system complying with NFPA 13 can usually be found in one of the following sources: building code; federal, state or local regulations; insurer's requirements; accreditation requirements; or owner's request.

SUMMARY

At the heart of the present invention is the inventor's realization that many, if not most or all, currently installed fire-barriers, even those with mandated fire-barrier covers (referred to in the industry as "boots"), are at risk of coming into contact with various forms of moisture. This is of utmost importance because recently it was recognized that when moisture comes into contact with a barrier, the barrier likely will be weakened to the point of having the effectiveness of the barrier irrevocably destroyed. In fact, once a fire-barrier is wet, its effectiveness is destroyed, thus it loses its certification and must be replaced. Fire regulations now require a moisture impermeable cover to be placed over the barrier, hoping to protect it from damage due to water or other fluids or chemicals.

Even though a fire-barrier cover-plate and a fire-barrier are correctly installed into an expansion-joint space, the present inventor realized that it is nearly impossible to prevent damaging moisture from reaching barriers. For example, fire-barriers, especially those installed between adjacent floor units, are subjected to daily stress from exposure to moisture, especially from water and cleaning chemicals used for floor washing that can leak through the smallest of openings even when a boot (cover-plate) has been installed. Heavy rain combined with strong wind can cause water to permeate even very small openings in the sides of buildings, causing wetting of the tops and even sides and bottoms of fire-barriers. Water escaping from planters, such as built-in planter units, can reach barriers. Water from repeated condensation events can impair the effectiveness of a barrier, thus destroying its certification. In some instances, sections of, if not an entire structure, are open to the outdoors, where rain and melted snow can collect on the floors to seep through spaces adjacent fire-barrier covers. Public facilities, such as open stadiums are regularly subjected to the effects of rain and snow. Fire-barrier failure in any of these facilities can result in unnecessary hazard to life and to the facility. And now that life-saving sprinkler systems are becoming more and more required, fire-barriers are subject to damage from water released from fire-sprinklers during isolated fire events. Such water can wet nearby barriers from the top, bottom, or side depending of the relationship of the barrier to the water emanating from the sprinklers. As mentioned above, repeated exposure to moisture results in deterioration of the barrier and loss of its certification necessitating replacement.

Although the fire-barrier covers are mandated, their very presence can often be problematic. Fire-barrier covers are usually about 4 inches thick while currently manufactured building units, including floors, are frequently constructed from pre-cast concrete slabs that are only 4½ inches thick, leaving only ½ inch of space for the installation of a fire-barrier into expansion spaces between floor units. It is imperative that the boot does not protrude above the floor surface, as it would create a tripping hazard and would expose itself to damage. If the boots are damaged by, for example, machines that are used to wash, maintain, or repair a floor it becomes likely that moisture will reach the barriers. The thickness of presently available boots required to protect presently vulnerable fire-barriers and the minimal thickness of the pre-cast floor sections act together to eliminate both top and side-mounting of fire-barrier into floor joint spaces, requiring bottom-mount fire-barriers.

Historically fire-barriers have been manufactured using materials that are either resistant to fire or do not burn, such as mineral wool, fiberglass, rock wool and other similar high temperature, mineral based or otherwise inorganic materials. Such materials have been, and still are, used to insulate furnaces or otherwise keep heat from moving to areas that are required to be kept cool. Some common applications include linings of kitchen ovens, residential furnaces, boilers, and fire barriers. The key is that these materials are all high temperature inorganic materials and are not plastic, polymer, or organic materials. It is not obvious that a polymeric material or any organic, low temperature, combustible material would be used as part of a fire-barrier. Historically, fire-barriers and even the first Fireline fire-barriers where constructed using such inorganic or mineral based materials. These inorganic or mineral based materials were, and still are, formed into mineral fibers or whiskers that are then woven into blankets or loose arrays of non-continuous filaments that are loosely arranged and held in place with sol-gel type binders. The binders are stable at high temperatures and do well in holding an array of fibers in a loosely packed geometric shape. These materials are subsequently made into protective cloths, insulation blankets, felts, boards or sheets. Key to the thermal insulating properties of these materials is this loosely packed array of fibers which creates a highly porous structure. The pore voids of the loosely woven material provide for much better insulating properties than the solid materials. The effectiveness of such materials as thermal insulators depends on their thermal resistance, thermal conductivity, specific heat, both closed and open porosity, and volume of dead air, or not connective air spaces within the structure or layer. However, the protective cloths and insulation blankets made using this technology, and which are typically used in the manufacture of high-temperature fire-barriers, are friable and can easily be damaged when abraded, compressed or altered by exposure to other conductive materials, like liquids that can dissolve, dilute or otherwise alter the solo-gel or other binding agents used to hold fibers of fire resistant materials in a loose fiber structure. When moisture or water comes in contact with a fiber structure, the fiber structure tends to compress or matt, similar to paper becoming wet and the resulting structure increases the materials thermal conductivity, reduces its composite specific heat and, accordingly, reduces its effectiveness as a fire barrier. In addition, when moisture or water is within the structure and then becomes heated, the resulting higher temperatures of the trapped fluids will become super heated, in the case of water, the result is steam which will expand, penetrate and destroy any fibrous structure. When these cloths and blankets are exposed to moisture, such as water, the moisture is rapidly absorbed by the cloth or blanket and quickly destroys their fire resistant properties. The net effectiveness of a fire-barrier when wet is compromised. It is likely that even if the cloth or blanket is dried out, it will never regain its original thermal insulating properties. While it is clear that to maintain the effective properties of a fire-barrier, they blanket needs to be keep dry, it is not obvious how this can be achieved.

Thus, the present Inventor set about to design fire-barriers that could be used at top-mount, side-mount, and bottom-mount and where each style of barrier was impervious to the presence of water. Moreover, the Inventor wanted moisture impervious barriers that could be used in the complicated geometry of spaces created when expansion space intersect. Additionally, the Inventor wanted each of the moisture impermeable fire-barriers to be tested, rated in terms of hours, and certified. And, the Inventor wanted his barriers to be pre-manufactured according to site-specific qualifications so as to arrive at the construction site ready for one-step, drop-in installation.

Accordingly, the inventor conceived and developed a set of inventive principles to result in the manufacture of fire-barriers that are, and will remain, safe from the detrimental effects of moisture and water for the life of the barrier. These principles provide for fire-barriers that are both gas and water-impermeable. The impermeability properties of the barriers are manufactured according to the need. Barriers that are situated so that water can reach only the top surface are manufactured to have a completely impermeable top surface. Alternatively, the barriers made according to the principles of the present invention, can be manufactured to be water-impermeable on the top and sides or on the top, sides, and bottom. If desired, of course any combination of sides, top, and bottom can be manufactured with water-impermeable surfaces. Furthermore, the principles taught herein provide for a full-complement of fire-barriers to be manufactured to be water-impermeable. The series of barriers having impermeable surfaces include barriers variously shaped and sized to fit into straight-line expansion spaces, as well as barriers shaped and sized to fit into multidimensional/multidirectional expansion spaces created by the intersection of a plurality of expansions spaces of a different orientation, direction, or plane, or any combination thereof. The barriers taught herein are built according to their tested and certified requirements, in a testing agency approved facility, and using a testing agency approved method, ready for drop-in, one-step installation upon delivery to the site, without any alterations being required. A water-impermeable fire barrier, alternatively referred to as a Water Guard fire-barrier was tested under UL 2079 and ASTM E 1399 testing specifications at the Intertek Testing facility in Texas on Mar. 17, 2008 and earned a two-hour rating. A three-hour rating was accorded via an engineering judgment. The various styles of water-impermeable barriers include barriers that may be installed over, within, or under the desired building units that bound the expansion spaces. That is, the method of installation is not limited as it is when boots are required. The barriers are constructed so that they remain impermeable even when supporting water puddling on their surface regardless of the amount of water or the length of time in contact with the water. These barriers are designed, constructed, and installed with the weight of any standing water taken into consideration when planning their support means. With this safeguard in place, the impermeable barriers can use the weight as an added safeguard in keeping the barrier fitting snugly against the building units to which they may be attached.

Alternatively, if desired, the water, moisture, and gas impermeable barriers may be fitted with a drain and a drainage hose providing for drainage of any water that does collect within the barrier, especially for when the barriers are to be used in floor to floor or floor to ceiling expansion-joint spaces, or any other joint spaces that frequently could be a likely repository for water and/or other liquids. The drainage tube is constructed so the when there is a fire the drainage opening is automatically plugged. The heat of the fire destroys the tube but at the same time melts the tube material so that it functionally plugs the drain opening.

One fire-barrier of the present invention is shaped and sized as required for installation into floor to floor expansion-joint spaces of an open-air baseball stadium, where the floors are heavily trod and frequently exposed to rain, melting snow and ice, and salty water. In this instance, the barrier would be bottom mounted to provide ample room for the inset installation of a cover to avoid any tripping hazards and so that the barrier's mounting hardware is not exposed to the elements. Such a barrier could also be fitted with drainage hoses to prevent the build-up of any fluid if that were to be desired. The prefabricated fire-barriers of the present invention are produced in various lengths as desired. However, because of the weight of the barriers and the difficulty in handling very long barriers, the length of the barriers is usually limited to, for example, ten feet. Moreover, if the weight of the barrier dictates, a barrier may often be manufactured to be four feet long. Therefore, when the expansion-joint space is longer than that the manufactured barriers, two or more barriers must be installed end to end to accommodate the length of the joint space. The barriers of the present invention are pre-assembled and delivered to the site ready for one-step, easy, rapid installation by one or at most two installers. The barriers, either partially or completely encapsulated by an impermeable layer of material, are pre-assembled to have male and female butt-end connections that prevent any possible leaking from end to end seams. For seams made up of butt-end to butt-end connections, a butt-cover is available to ensure that there is no leakage of any collected fluids except through the drainage system. The seam-butt cover also adds extra assurance against the penetration of smoke or fire into the barrier from below the barrier.

Using a silicone treated high-temperature resistant fabric to partially or totally encapsulate a barrier, is one example of how to make the barrier totally moisture impermeable. It should be understood that the water and gas impermeable fire-barriers as taught herein must be able to maintain their high temperature resistance and gas and flame impermeability to about 500° F. in order to be a fully-functional, expansion-joint space fire-barrier. A base material, often referred to in the trade as a "protective blanket" could be a vermiculite-treated fiber-glass fabric having a 2000° F. rating. In one case, this type of protective blanket is treated with a water-impermeable material such a silicone. The treatment could be a coating, impregnating, dip-cure or a laminating process, for example. It should be understood that any coating or other addition of a material that imparts water impermeability to the fabric being treated need not be continuous, but sufficiently dense to prevent moisture or liquid penetration. Regardless of the specific treatment used, addition of a material that imparts the property of water and moisture impermeability to a porous material provides a barrier to liquids that could, if they penetrate the structure, result in mechanical and chemical damage which could render the fire barrier ineffective. Another example is to treat the high temperature base material fabrics with a processed silicon rubber coating. Also used to coat high-temperature porous materials, such as protective cloths, is PTFE (Teflon®). The manufacture and use of water-impermeable fire-barriers that present all of the above benefits are described more fully below.

BRIEF DESCRIPTION OF THE DRAWINGS

In order that these and other objects, features, and advantages of the present invention may be more fully comprehended, the invention will now be described, by way of example, with reference to the accompanying drawings, wherein like reference characters indicate like parts throughout the several figures, and in which.

DEFINITIONS

Figures 1A, 1B:
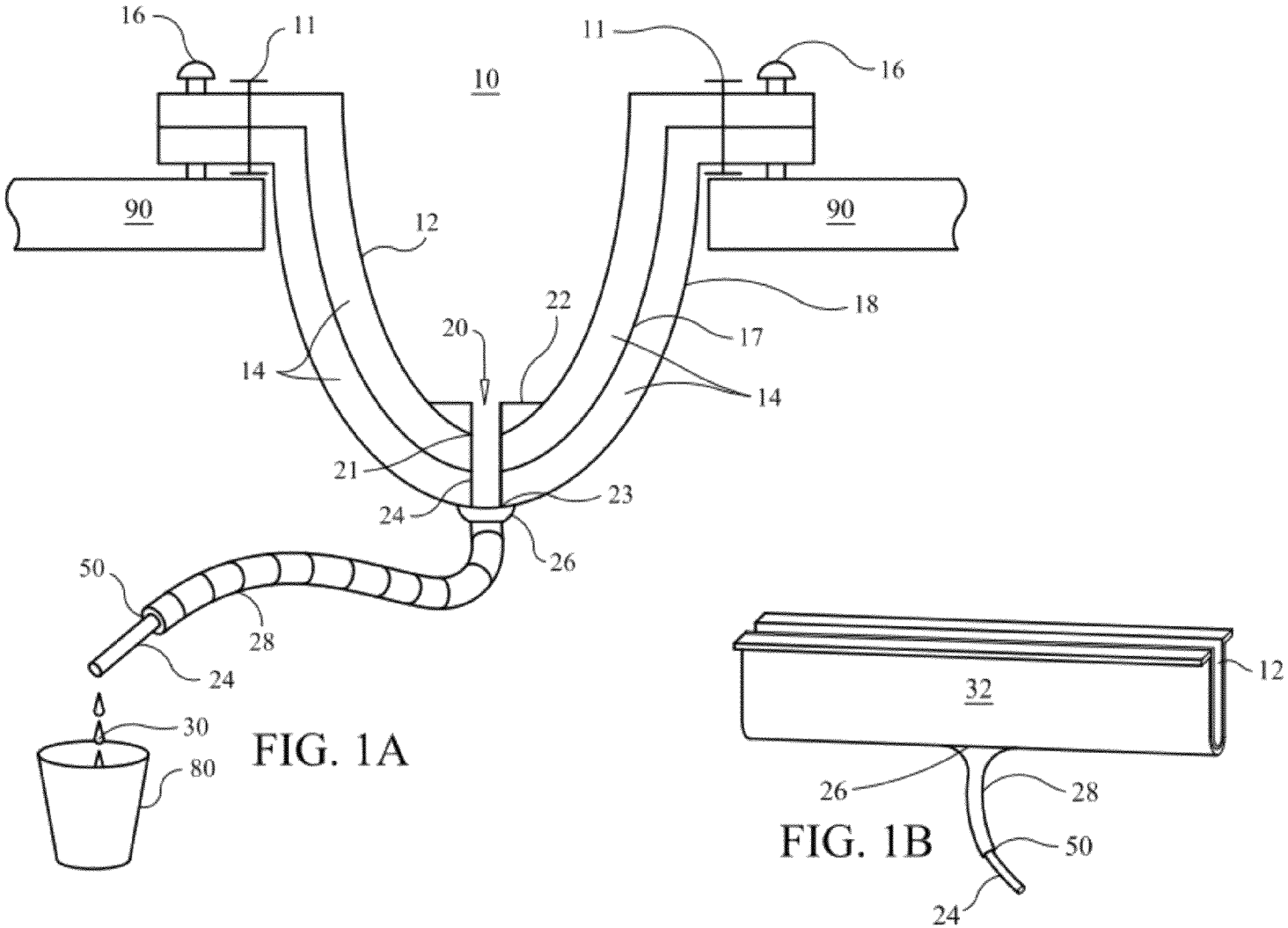
FIG. 1A is a diagrammatic cross-sectional and partially perspective view of a straight-line, top-mount, top-side moisture and gas impermeable fire-barrier having a self-draining system according to the principles of the present invention installed into a floor expansion-joint.
FIG. 1B is a diagrammatic perspective side-view of top-side moisture impermeable fire-barrier with a self-draining system, as shown in FIG. 1A.

Building units, as used herein, refers to building structures such as walls, floors, ceilings, and the like, and may be referred to as structural units.

Cover, as used herein, means to protect and/or conceal.

Cover-up, as used herein, means to cover completely, enfold for protection and concealment.

Encase, as used herein, means to surround entirely.

Enclose, as used herein, means to shut in; to enclose in on all sides, as to surround.

Envelope, as used herein, means to enclose.

Wrap, as used herein, means to wind, fold, or bind around an object as to cover it for protection.

High-temperature thread, as used herein, refers to any thread that is fire-resistant or any thread that will not support combustion, such as a ceramic thread.

Water-impermeable high-temperature fabric, as used herein, refers to a high-temperature (about 500° F.) resistant material that does not allow the passage of a fluid, such as water, other liquids, and/or gases. One example of a water-impermeable fabric disclosed herein includes a flexible, high-temperature resistant water-impermeable fabric manufactured from a high-temperature resistant woven cloth treated with a material that imparts water, gas, and moisture impermeability to the fabric. Such water-impermeable high-temperature resistant fabrics and added to one of more fire-barrier surfaces to protect them from coming into contact with water. Such impermeable protective cloth layers can be treated with a variety of materials, such as, but not limited to, high-temperature resistant silicone, PTFE, silicon rubber, coal tar, bitumen and other high-temperature synthetic polymers. The methods used to apply the moisture impermeable material include, but are not limited to, coating, impregnation, laminating, and dip-cure.

Intumescent as used herein, refers to those materials having properties that cause them to expand (or intumesce) to several times their original size when activated by high temperatures to prevent the spread of flames and smoke to other parts of a building, for example passive fire-seals contain intumescent compounds. The intumescent occurs in many forms and may be, for example an intumescent layer, strip, or paste, such as a caulking material.

Insulation blanket, as used herein, refers to any number of insulation materials, including high-temperature and fire resistant fiber blankets made from alumina, zirconia, and silica spun ceramic fibers, fiberglass, and the like.

Metallic backing layer, as used herein, refers to fire-resistant metal or metallicized foil, such as stainless steel, or the like.

Intersection Expansion-joint Space, as used herein, refers to any joint that is formed by the intersection of two or more expansion-joints. Intersection joint spaces are also referred to as multi-directional and/or multi-dimensional architectural expansion-joint spaces because of their geometry. These spaces can be simple L-shapes, cross-shaped, T-shaped, or a combination of the various shapes.

Intersection Joint Space Fire-barrier, as used herein, refers to fire-barriers shaped to fit into an intersection expansion-joint space, also referred to as multi-directional and/or multi-dimensional architectural expansion-joint spaces that are formed by the intersection of variously oriented expansion-joint spaces, such as when a floor expansion-joint space intersects a wall expansion-joint space.

Protective cloth, as used herein, refers to a flexible, woven, strong fire-resistant material designed to maintain its integrity up to about 2000° F. It is used to mechanically support the thick insulation blanket and to protect it from mechanical damage, as the insulation blanket while fire and heat-resistant is mechanically weak and can be easily damaged by tearing or ripping during or after installation, which would seriously compromise the integrity of the finished fire-resistant barrier. Protective cloth is also used as the base material in the manufacture of high-temperature resistant water and gas impermeable cloth. The various fire-resistant layers, such as a layer of insulation material and protective cloth, can freely move with respect to the one or more protective layers or they may be attached together via threads or other attaching means. Protective cloths may be manufactured from continuous filament woven amorphous silica yarns, woven polymeric material, fiber reinforced woven polymeric material, high-temperature resistant woven textiles, or a woven metalized, fiberglass cloth, among others. Metalized cloth may include fibers of stainless steel, aluminum, or copper, for example. Protective cloths are cloths that are woven to provide the porosity required for insulation and to provide for shear, including lateral, motion. Protective materials may also include metal foils or metal screens.

Retainer, as used herein, refers to a means used to attach fire-barriers to building units. For example one top-mount system uses "L" brackets that are first attached to the barrier and then attached to a building unit. Similar brackets are used for mounting bottom-mount and side-mount systems.

Seaming, as used herein, refers to connecting one part to another part, for example where a cloth is folded and the two parts of the cloth that have been brought together by the folding are subsequently "seamed" together along a predetermined line. The seaming may utilize stitching, using an adhesive, stapling, pinning, or any other means that will connect the two parts to each other.

Structural unit, as used herein, refers to such building unit constructs as a wall, floor, ceiling, or the like and may be referred to as building units. These units are often pre-constructed concrete, or of a like material, slabs or panels and can be about 4 inches thick which poses a challenge for the installation of a fire-barrier and the, recently, mandated rubber protective boot.

T-shaped, as used herein, refers to both an intersection expansion-joint that is formed by the intersection of three expansion-joint spaces and to a fire-barrier that is shaped to be received into a T-shaped intersection expansion-joint space.

Tests:

Fire testing per UL 2079

Cycle test ASTME 1399 (expansion, compression test)

A LIST OF THE REFERENCE NUMBERS AND RELATED PARTS OF THE INVENTION

10 Fluid and moisture impermeable fire-barrier.
11 Attachment means for securing the barrier's layers together.
12 Impermeable high-temperature and fire resistant treated protective cloth.
14 High-temperature and fire resistant insulation blanket.
15 Intumescent strip material.
16 Attachment means, such as pins and washers.
17 Metal foil.
18 High-temperature and fire resistant protective cloth.
19 Attachment means.
20 Drain system.
21 Inner aperture.
22 Impermeable caulk material.
23 Outer aperture.
24 Plastic tubing.
26 Impermeable fire- and heat-resistant caulk material.
28 Flexible metal fire- and heat-resistant tubing.
29 Attachment means, such as washers and nuts.
30 Fluid, such as water.
32 One fire-barrier section impermeable to fluid and moisture.
34 Another fire-barrier section impermeable to fluid and moisture.
40 Folds of the cloth.
44 Retainer.
50 Intumescent caulking.
60 A join or butt between two fluid and moisture impermeable fire-barriers.
70 A butt or splice cover connector.
80 Fluid catchment means.
90 A building unit.
100 A moisture impermeable fire-barrier installed into a floor/wall expansion space join.
200 Male connection end.
202 Female connection end.
300 Test tank.

DETAILED DESCRIPTION

To provide an understanding of the basic structure of the moisture and gas impermeable fire-barriers as taught herein, we now refer to the drawings to illustrate exemplary versions of the invention. It should be noted that the disclosed invention is disposed to versions in various sizes, lengths, widths, and thicknesses, as well as to a variety of shapes to accommodate the large variety of geometrically complex intersection expansion-joint spaces, in addition to variation in the materials used to manufacture the fire-barriers, the number of layers, and the attachment means used. Therefore, the versions described herein are provided with the understanding that the examples presented are intended as illustrative and are not intended to limit the invention to the examples described.

FIG. 1A, a cross-sectional diagrammatic view, illustrates a straight-line, top-mount, top-surface moisture-impermeable fire-barrier of the present invention installed in an expansion-joint space of a given width formed by opposing building units 90. It is to be understood that the invention also is available in any of the geometrically complex fire-barriers shaped to fit variously shaped expansion joint spaces created by the intersection of a variety of expansion joint spaces. In this example, the construction of gas, fluid, and moisture impermeable fire-barrier 10 starts with a bottom, outermost layer of protective cloth 18, such as woven material that is fire- and heat-resistant to about 2000° F., overlain by a thick layer of insulation blanket 14, which is overlain by a sheet of stainless steel foil 17. In this example, the fire-barrier has another layer of thick insulation blanket 14. The water, gas, and moisture impermeable property is added to the basic fire barrier by the addition of a layer of fire- and heat-resistant (to about 500° F.) moisture impermeable fabric 12. Water, gas, and moisture impermeable fabric that is also resistant to the high-temperatures encountered in a building fire is made by treating a water-permeable porous high-temperature resistant fabric with a material that imparts a water, moisture, and gas impermeable property to the fabric. One example of a heat-resistant (to about 500° F.) moisture impermeable material is woven protective cloth treated with silicone. Other examples of materials that impart a water, moisture, and gas impermeable property to porous, heat-resistant fabrics, include, but are not limited to, polytetrafluoroethylene and silicone rubber. The methods of treating a water-permeable porous high-temperature resistant fabric with a material that imparts a water, moisture, and gas impermeable property to the fabric includes, but are not limited to coating, coating, impregnation, laminating, and dip-cure methods. It should be understood that, if desired, the top surface edges of the fire-barrier's multi-layers may be overlaid by intumescent material (not shown). Also illustrated are attachment means 16, such as pins that are used to attach the barrier to a building unit. In this example, pins 11 attach the individual layers that make up fire-barrier 10 to each other. It should be understood that all of the layers need not be attached to each other using one attachment means.

According to the principles of the present invention, optional drain 20 provides drainage for any liquid that collects on the inner surface of the impermeable layer. Drain 20 is protected against leakage by an application of impermeable, fire resistant, caulk 22. Gravity provides the force that drains the water through the aperture on the surface of the impermeable layer at the lowest depression of the u-shaped fire-barrier into inner-opening 21 to and through plastic tubing 24 and outer aperture 23 that also is sealed against leakage by an application of impermeable fire-resistant caulk 26 to continue through the plastic tubing that extends out through the lower outer surface of the barrier. Because the tubing used in this example is plastic and would quickly be affected by heat from a fire, and perhaps from other environmental conditions, it is protected by an outer layer of flexible metal fire-resistant tubing 28. After passing through the length of the metal tubing, a length of the plastic tubing emanates out of metal fire-resistant tubing 28. Liquid 30 traveling through the tubing will eventually be collected by some kind of fluid catch means 80. Intumescent caulking 50 is inserted between the outer surface of plastic tubing 24 and the inner surface of metal tubing 28 near the end of tubing 24. In the event of a fire, intumescent caulking 50 will expand to provide a seal about the opening. Metal tubing 28 will force the expansion of intumescent caulking toward the plastic tubing which will cause the tubing to collapse upon itself and, thus, create a seal preventing any fire, hot air, gases, or smoke from getting through the barrier and spreading to other areas of the building.

FIG. 1B, a diagrammatic perspective side-view of a moisture impermeable fire-barrier, illustrates the positioning of drain system 20 equidistant from both ends of section 32 of the impermeable fire-barrier. The length of each impermeable fire-barrier section is, to some extent, dependent on the weight of the barrier, as well as the length of the joint space that requires a barrier. If the barrier is constructed with extra layers of material, for example to provide for a barrier having a higher fire-rating (i.e., in terms of the hours the barrier can withstand the destructive forces of a full-scale fire) the barrier will weigh more and might have to be designed to be shorter than a barrier rated for fewer hours and made of a reduced thickness.

Figure 2A:
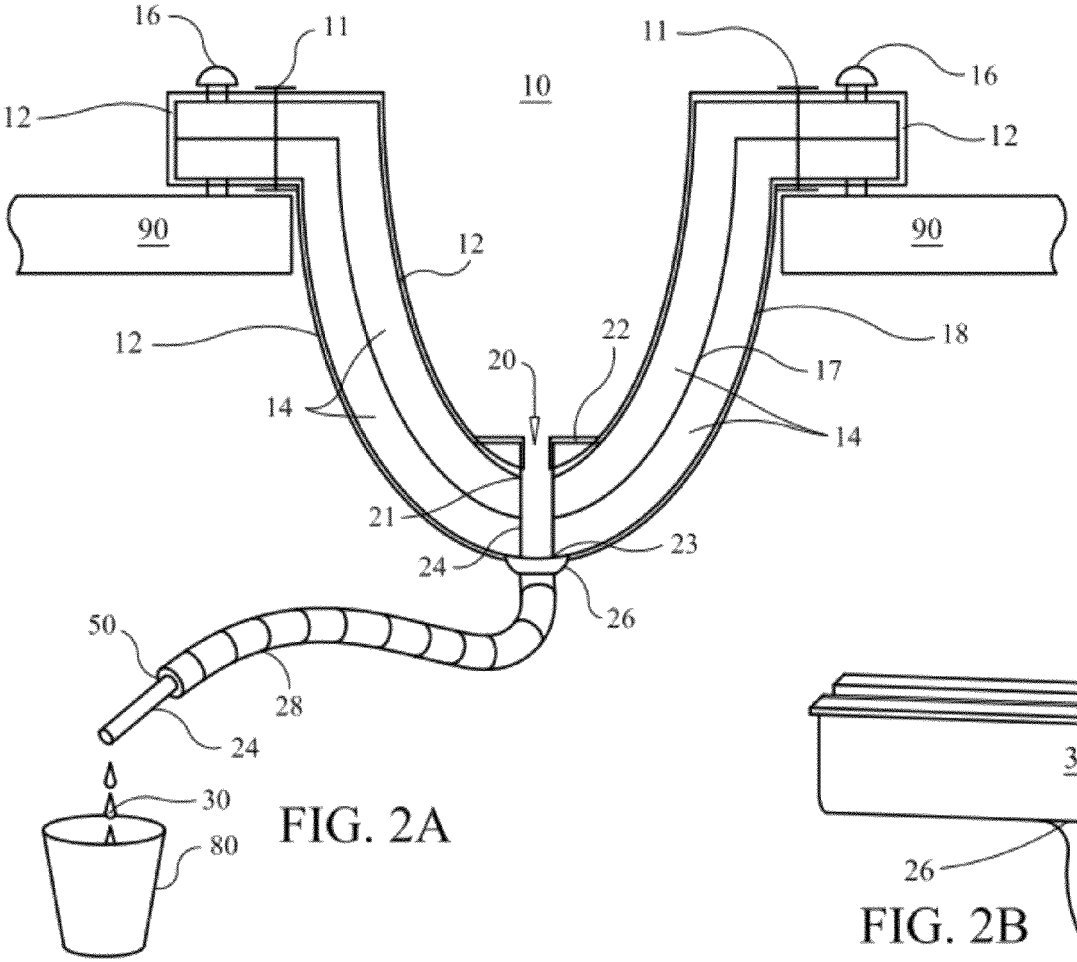
FIG. 2A is a diagrammatic cross-sectional and perspective view of a straight-line, top-mount, fire-barrier totally encased within a moisture and gas impermeable cloth having a self-draining system according to the principles of the present invention ready for installation into a floor expansion-joint.

FIG. 2A, a diagrammatic cross-sectional and partly perspective view, illustrates a water and gas impermeable, straight-line, top-mount fire-barrier 10 that is totally-encased in a water and vapor impermeable cloth 12 according to the principles of the present invention. Water and gas impermeable fire-barrier 10 is installed in an expansion-joint formed by opposing building units 90. It should be understood that fire-barriers that are totally-encased in water and vapor impermeable cloth are also available in any one of the geometrically complex fire-barriers shaped to fit variously shaped expansion-joint spaces created by the intersection of a variety of expansion-joint spaces. In this example, gas and fluid impermeable fire-barrier 10 includes impermeable outer layer 12 completely covering the multi-layer layer fire-barrier. Complete covering means that the sides, top, bottom, and ends of the fire-barrier are protected from moisture by an impermeable cover layer. The structure of the fire-barrier can be described as having one layer of woven fabric heat-resistant to 2000° F. 18, referred to in trade as "protective cloth, which is a fire-resistant fiberglass material know as "Z-600" cloth, overlain by a layer of ceramic fiber insulation blanket 14, which is overlain by a sheet of stainless steel foil 17; over the steel foil is another layer of insulation blanket 14 forming the basic inner structure of the illustrated fire-barrier. Wrapped about the entire inner basic fire-barrier structure is a layer of gas and moisture impermeable material 12, an example of which is silicone treated woven fire and high-heat-resistant fiber-glass cloth, where the surface edges of the inner multi-layer are overlaid by intumescent material (not shown). In this example, the layers making up the barrier are attached to each other using attachment pins and washers 11, although it should be understood that such attachment can be done in many ways. In some embodiments the layers may be sewn together. The completely moisture impermeable fire-barrier is shown attached to building units 90, in this example, by the use of tack-weld pins 16. There are many attachment means that may be used to attach a fire-barrier to a building unit in addition to the means mentioned and all are contemplated for use with the present invention and include screw, bolts, nails or a fire-resistant adhesive. One favored embodiment uses a retainer attachment apparatus to attach a fire-barrier to the building structures that define the expansion-joint space. The retainer attachment is generally fixedly attached to the fire-barrier at the time of manufacture. See FIG. 4 for an example of a retainer attachment means. For all specified joint-space widths and depths, the fire-barriers are fully pre-assembled at the factory and are ready for one-step, on-site installation.

It may be expected that in many cases, water will reach an installed fire-barrier. For example, fire-barriers are routinely installed in floor to floor joint spaces. It is to be expected, especially in large public buildings, that the floors are regularly washed with copious amount of water and cleaning chemicals. The people who wash the floors are routine building cleaners who likely do not think about protecting such items as the completely hidden from their view fire-barriers installed beneath the floors. Optional drain 20 provides drainage for any liquid that is able to collect on the inner surface of the impermeable layer. Leakage about the outer-surface of drain 20 is prevented by an application of impermeable, fire resistant, caulk 22. Liquid drains through aperture 21 on the surface of the impermeable layer through plastic tubing 24 and outer aperture 23 that also is sealed against leakage by an application of impermeable fire-resistant caulk 26 to continue through the plastic tubing that extends out through the lower outer surface of the barrier. Because the tubing used in this example is plastic and would quickly be affected by heat from a fire, and perhaps from other environmental conditions, it is protected by an outer layer of flexible metal fire-resistant tubing 28. After passing through the length of the metal tubing, a length of the plastic tubing emanates out of metal fire-resistant tubing 28. Liquid 30 traveling through the tubing will eventually be collected by some kind of fluid catch means 80. Intumescent caulking 50 is inserted between the outer surface of plastic tubing 24 and the inner surface of metal tubing 28 near the end of tubing 24. In the event of a fire, intumescent caulking 50 will expand to provide a seal about the opening. Metal tubing 28 will force the expansion of intumescent caulking toward the plastic tubing which will cause the tubing to collapse upon itself and, thus, create a seal.

Figure 2B:
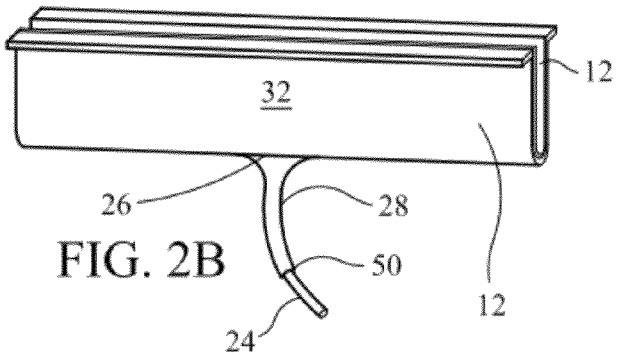
FIG. 2B is a diagrammatic perspective side-view of the totally encased moisture impermeable fire-barrier shown in FIG. 2A.

FIG. 2B, a diagrammatic perspective side-view of a moisture and gas impermeable fire-barrier as shown is FIG. 2A, illustrates the positioning of drain system 20 equidistant from both open ends of the section 32 of the fire-barrier. The length of each impermeable fire-barrier section is, to some extent, dependent on the weight of the barrier, as well as the length of the joint space that requires a barrier.

Figure 3:
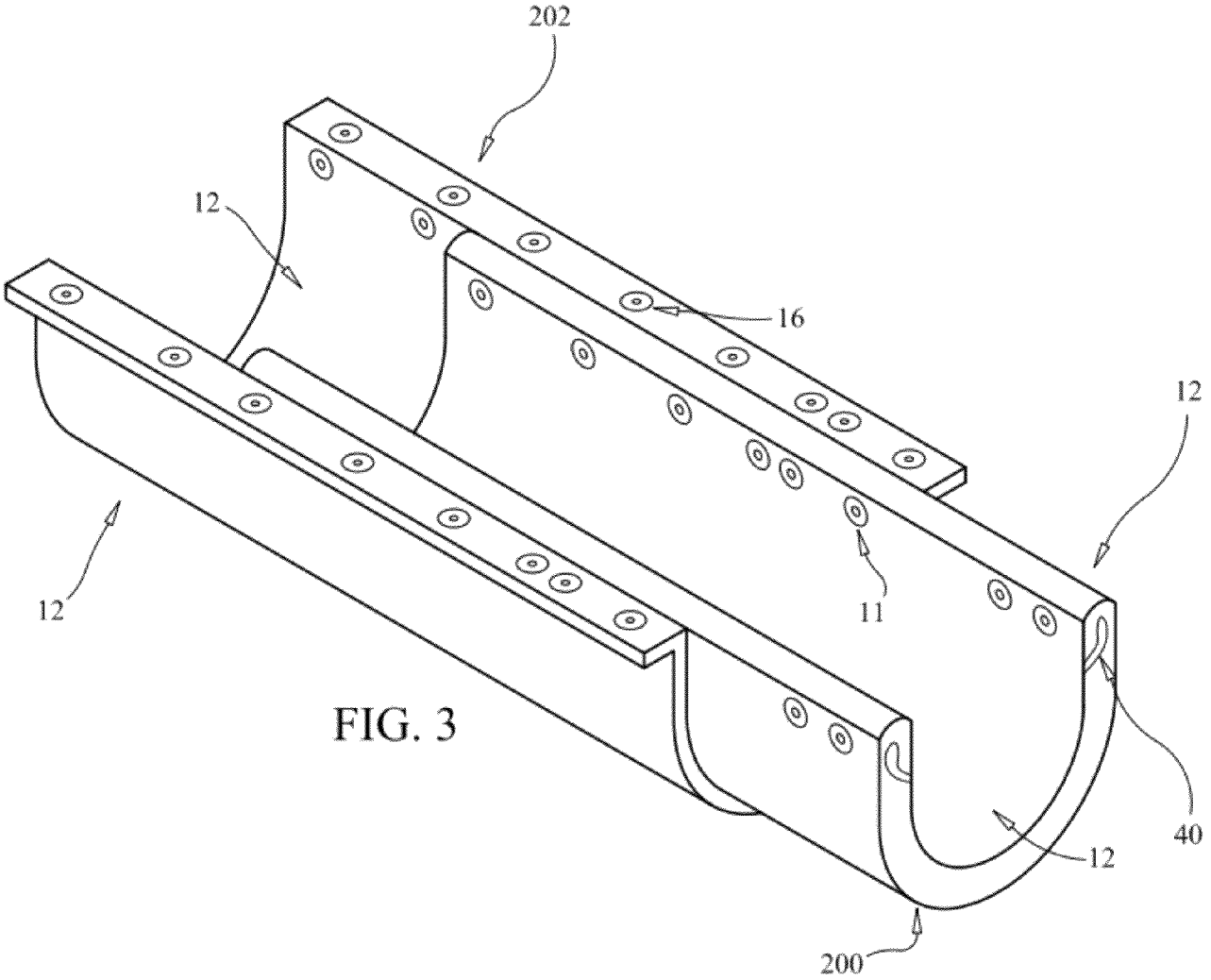
FIG. 3 is a diagrammatic perspective view of a straight-line bottom-mount fire-barrier totally encased within a moisture and gas impermeable cloth according to the principles of the present invention ready for installation.

FIG. 3, a perspective view, illustrates a bottom-mount with male/female joins, moisture impermeable fire-barrier of the present invention ready for installation in an expansion-joint. In this example, gas, fluid, and moisture impermeable fire-barrier 10 includes impermeable outer layer 12 completely covering a multi-layer layer fire-barrier, as was discussed above in relation to FIGS. 2*a* and 2*b*, which means that all sides, top, bottom, and ends of the fire-barrier are protected from moisture by an impermeable cover layer. In the illustrated embodiment, pins 11 securely attach the layers of the barrier each other. If it the installation of the barrier into the expansion space must be done from above the floor, attachment means 16 can be used for securely attaching each long side of the fire-barrier to a metal retainer mounting bracket. Each retainer is situated above the flange extension of the fire-barrier layer and, in turn underlies the bottom surface of a building unit. Attaching the fairly rigid retainer to the flexible fire-barrier provides for the barrier to be held tightly against the bottom surface of the building unit providing for a tight and secure attachment. Fold lines 40 represent the fact that, in this example, at each long end the impermeable silicon cloth is folded and tucked between the layers that make up the barrier. The barrier illustrated in FIG. 3 has male connection end 200 and female connection end 202 that each provide not only a simple one-step process of joining one barrier to another, but a join that ensures that no water, gas, hot air, or fire can pass through the barrier. Note that the mating ends of each section of barrier are joined so that each material layer directly mates with an identical layer material (see FIG. 3B). For example, a layer of woven fabric heat-resistant to 2000° F. would mate directly against the same woven fabric heat-resistant to 2000° F., and a layer of a ceramic fiber insulation blanket would mate directly against the same ceramic fiber insulation blanket material. This prevents the gaps that are seen in other teachings where one end of a mating system (that is not male/female) is completely overlapped by the outer layer of protective blanket material making layer to layer direct mating impossible, and worse, creating a gap through which smoke, heat, and flame can travel.

Figure 3B:
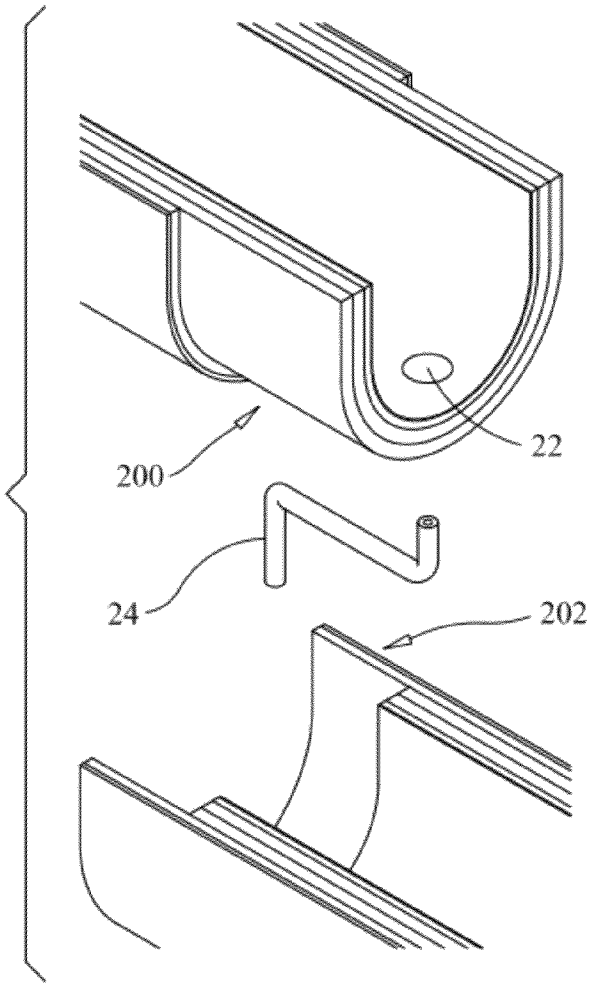
FIG. 3B is a diagrammatic perspective view of the two sections of straight-line fire-barrier, as shown in FIG. 3A, to show the male/female connection means used to join the two sections.
Figure 3A:
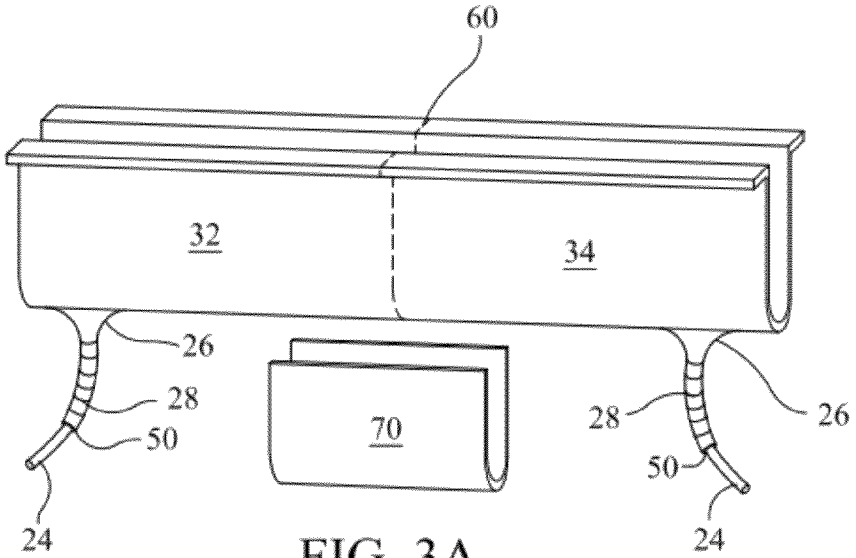
FIG. 3A is a partial diagrammatic perspective view illustrating two sections of just joined bottom-mount, straight-line, fire-barriers of the present invention and a butt cover about to be installed over the join to provide additional protection to the join to assure that no fire, heat, or smoke can enter the barrier from fire activity below the barrier.

FIG. 3A, a diagrammatic perspective view, shows that once two sections are joined, the fact that one section has a male connection end and the other section has a mating female connection end cannot be seen. The male/female connection ends ensure that the barrier will protect against any penetration of smoke, heat, or fire. However, if desired, an optional join cover 70 is available to cover join 60 that can be seen between the two top-mount straight-line fire-barrier partial sections 32 and 34. Once join cover 70 is secured over join line 60, all exposed join seams are subsequently caulked. FIG. 3B, a diagrammatic perspective view, illustrates male 200 and female 203 connection structures of partial sections 32 and 34.

Figure 4:
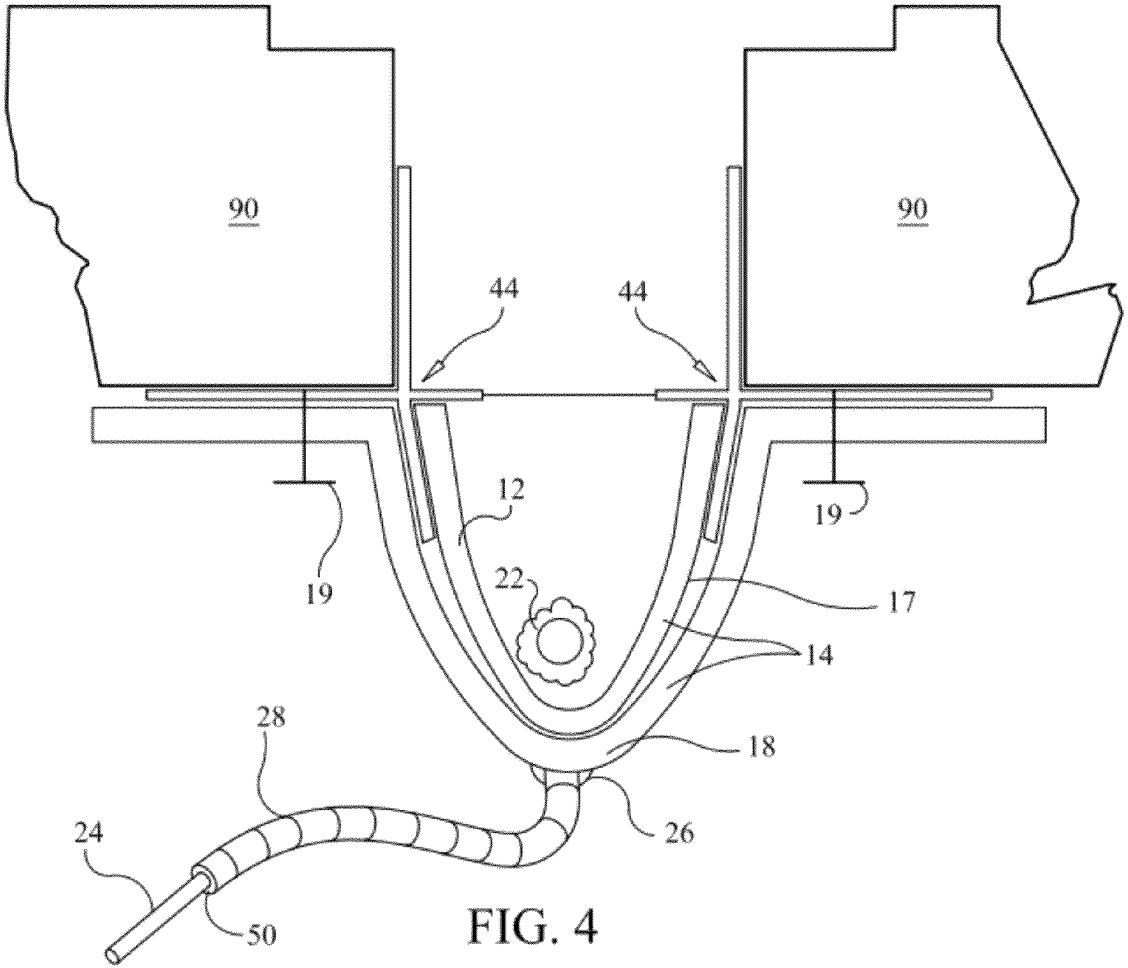
FIG. 4 is a cross-sectional, partially perspective, view of a bottom-mount, moisture impermeable fire-barrier of the present invention installed in an expansion-joint using a retainer system and illustrating the self-draining system.

FIG. 4, a cross-sectional partial perspective view, illustrates an example of a bottom-mount, moisture impermeable fire-barrier of the present invention being installed in what could be a floor to floor expansion-joint space. The bottom-mount fire-barrier system provides for installing the fire-barrier/retainer unit either from above the floor through the expansion-joint space, from beneath the floor, or from both. In this illustrated embodiment, the fire-barrier is securely attached to metal retainer mounting bracket 44 by attachment means 19 whose size is exaggerated for ease of viewing. Attachment means 19 extends through the barrier to and through the leg of the retainer that is positioned against the bottom of building unit 90 and into unit 90. Attachment means 19 may be any known and yet to be known desired attachment means, such as a nail gun that is a type of tool used to drive fasteners into a material that is usually driven by electromagnetism, compressed air, or, for powder-actuated tools a small explosive charge. One example of such a nail gun is a Hilti gun that inserts fasteners through the barrier/retainer into the pre-cast concrete floor in the present example. Note that by being mounted below the floor, there is adequate space in the expansion-joint for a required rubber boot (mandated barrier cover) to be installed. It is contemplated that retainer 44 be manufactured as part of the structure of moisture impermeable fire-barriers of the present invention to make the installation of the barrier faster, easier, safer, and thus, more cost effective. There are situations that require moisture and gas impermeable fire-barriers to be manufactured without a retainer. Such embodiments may include smaller and/or top or side mounted barriers. As discussed, in this example, the elongate fire-barrier illustrated has a length with two opposing long sides, which provide the attachment areas for attaching the fire-barrier/retainer to building units, and a u-shaped drooping center or mid-section between. Note that there is a separate retainer structure 44 for each side of the fire-barrier that is to be attached to a building unit that bounds an expansion space. Each retainer, as illustrated, may comprise four retainer arms or plates, thus has a four arm cross-sectional profile. In the example illustrated, there are two vertical retainer arms and two horizontal retainer arms. When installed, the downwardly extending part of the vertical arm of the retainer of the fire-barrier/retainer system is positioned to extend into the space between fire-barrier layers, while the vertical upwardly extending portion of the retainer arm is positioned against the sides of the building units that define the expansion-joint space to provide a secure and close connection of the fire-barrier/retainer system to the building units by acting in concert with the other arms to keep the fire-barrier is a correct position tight against the building unit surfaces. One part of the horizontal retainer arm is situated between the flange extension of one fire-barrier layer and the bottom surface of the building unit. The other, in this case, shorter opposing part of the horizontal retainer arm extends into the joint space to cover the exposed end of the inner-most fire-barrier layer, as illustrated, and also to provide a lifting support for an installation tool, when an installation tool is to be used. It is to be understood that there are many variations on the shape and size of a retainer. The arms could be of a variety of widths and lengths, and not all arms need be used or present. Note that in the illustration, one retainer arm of a first retainer is affixed between the layers of the first long side of the fire-barrier and one retainer arm of a second retainer is affixed between the layers of the opposing second long side of the fire-barrier to form the fire-barrier/retainer system for bottom mounting the system into an expansion-joint space. Attaching the fairly rigid retainer to the flexible fire-barrier provides for the barrier to be held tightly against the bottom surface of the floor unit providing for a tight and secure attachment (as illustrated).

Figure 5:
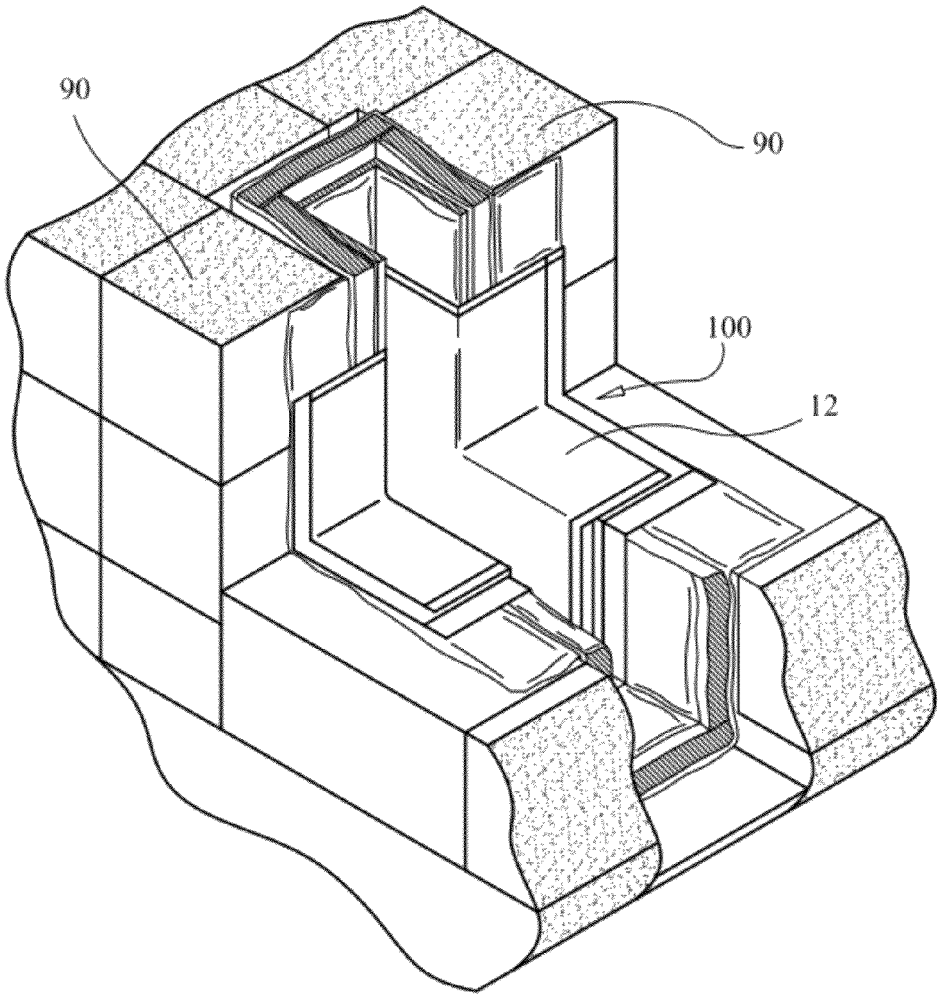
FIG. 5 is a diagrammatic perspective view of an L-shaped fire-barrier having two female connecting ends mounted into an L-shaped expansion-joint created by the intersection of a wall expansion-joint with a floor expansion-joint.

FIG. 5, a perspective view, illustrates one of the moisture impermeable fire-barriers sized and styled for its use as a one-piece, drop-in installation into a horizontal/vertical L-shaped intersection extension-joint space formed by the intersection of horizontal and vertical extension joint spaces. Note that this barrier is provided with two female connection ends to be used to connect to two male connection ends of two other barriers.

Figure 6:
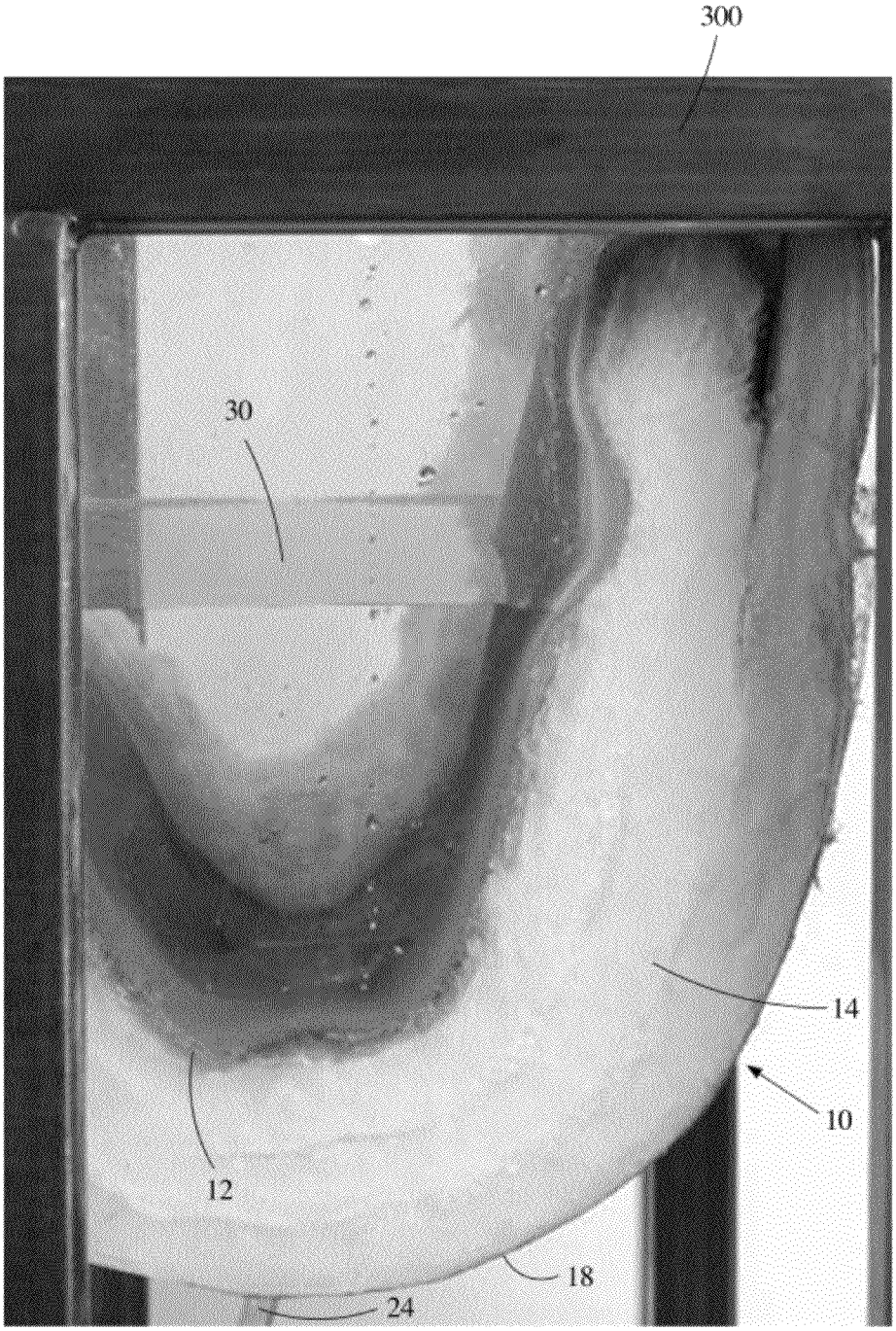
FIG. 6 is a photograph showing the experimental results of a straight-line bottom-mount moisture and gas impermeable fire-barrier of the present invention filled with water illustrating the water impermeability of the barrier and a plugged optional drain hose.

The moisture impermeability of the silicon cloth layer was tested by filling an installed fire-barrier having the silicon cloth layer with water. In this test water remained on the surface of the silicon layer for 120 days when the water finally and completely evaporated. A photograph was taken to substantiate the test results and is shown in FIG. 6. The water holding ability of the silicone treated cloth 12 is clearly shown. FIG. 6 is a photograph of a two-layer, straight line, fire-barrier with its top surface securely covered by an impermeable layer of silicone treated protective cloth. It should be understood that there are materials, other than silicone that can impart the desired water-impermeable properties to a porous fabric, as is discussed above and mentioned below. Attachment to building units is simulated by the walls of experimental water holding support device 300. FIG. 6 shows the inner droop of "installed" barrier 14 filled with water 30 and drainage tube 24 hanging down from the bottom of the barrier. For the experiment, the drainage aperture was closed to show how water-impermeable and how strong these fire-barriers are.

It likely may be expected that in many cases, water will reach an installed fire-barrier. For example, fire-barriers are routinely installed in floor to floor joint spaces. It is to be expected, especially in large public buildings, that the floors are regularly washed with copious amount of water and cleaning chemicals. Such barriers are also mandated to be installed in public buildings that may be partially open, such as open-air sports arenas. In such cases, in addition to floor washing liquids, there is rain and snow that can reach the barriers beneath the floor units. It must be understood that by law, once a fire-barrier is wet, it no longer is covered by its certification, and must be replaced.

Accordingly, a water-impermeable fire-barrier, comprising a fire-barrier for use in expansion-joint spaces constructed from a woven fabric heat-resistant to 2000° F.; a ceramic fiber insulation blanket, having a high-temperature resistant water-impermeable fabric comprising a high-temperature resistant water-permeable fabric treated with a material that imparts water impermeability attached to and enveloping at least one side of the fire-barrier, said water-impermeable fabric prohibiting moisture or water from entering said at least one side of said fire-barrier.

The foregoing description, for purposes of explanation, used specific and defined nomenclature to provide a thorough understanding of the invention. However, it will be apparent to one skilled in the art that the specific details are not required in order to practice the invention. The disclosed descriptions and illustrations are not intended to be exhaustive or to limit the invention to the precise forms disclosed. Those skilled in the art will recognize that many changes may be made to the features, embodiments, and methods of making the versions of the invention described herein without departing from the spirit and scope of the invention, such as adjusting the template patterns shown in the drawings and described above to fit the variety of other similar, but different, multi-dimensional expansion joints, as well as to fit the various sizes of multi-dimensional joints that require fire barriers. Furthermore, the present invention is not limited to the described methods, embodiments, features or combinations of features but include all the variation, methods, modifications, and combinations of features within the scope of the appended claims. The invention is limited only by the claims.

What is claimed is:

1. A water-impermeable fire-barrier for use in an expansion-joint space, comprising, a fire-barrier having water-impermeability structurally-integrated into a layer structure, said fire-barrier constructed from:

a layer of woven fabric heat-resistant to 2000° F., a layer of ceramic fiber insulation blanket, a layer of high-temperature resistant water-impermeable fabric, and layer attachments, said layers of woven fabric, insulation blanket, and high-temperature resistant water-impermeable fabric attached to each other with said layer attachments forming a unitary-piece fire-barrier ready for drop-in installation into an expansion joint space, said water-impermeable fabric prohibiting moisture or water from entering one or all sides of said fire-barrier providing for a water-impermeable fire-barrier.

2. The water-impermeable fire-barrier, as recited in claim 1, further having been tested, rated, and certified under UL 2079 and ASTM E 1399.

3. The water-impermeable fire-barrier, as recited in claim 1, wherein said material that imparts water impermeability is a silicone.

4. The water-impermeable fire-barrier, as recited in claim 1, wherein said material that imparts water impermeability is a polytetrafluoroethylene.

5. The water-impermeable fire-barrier, as recited in claim 1, wherein said material that imparts water impermeability is a silicone rubber.

6. The water-impermeable fire-barrier, as recited in claim 1, wherein said high-temperature resistant water-permeable fabric is treated using either a coating process or an impregnation process.

7. The water-impermeable fire-barrier, as recited in claim 1, wherein said water-impermeable fire-barrier is water-, moisture-, and gas-impermeable.

8. The water-impermeable fire-barrier, as recited in claim 1, wherein said water-impermeable fabric is heat-resistant to 500° F.

9. The water-impermeable fire-barrier, as recited in claim 1, wherein said fire-barrier is sized and styled to fit into accepting straight-line expansion-joint spaces and intersection expansion-joint spaces.

10. The water-impermeable fire-barrier, as recited in claim 1, wherein said water-impermeable fire-barrier is fitted with a drain.

11. The water-impermeable fire-barrier, as recited in claim 1, wherein said drain aperture has impermeable caulk material applied about it.

12. The water-impermeable fire-barrier, as recited in claim 10, wherein said drain has a drain hose.

13. The water-impermeable fire-barrier, as recited in claim 10, wherein said drain hose has an end extending below the water-impermeable fire-barrier, said end having an application of an intumescent to seal the hose in the event of a fire.

14. The water-impermeable fire-barrier, as recited in claim 1, wherein each of said fire-barrier's connection ends is formed into either a male or female shaped connecting end and the other end is formed into either a male or female shaped connecting end providing for flush male/female joining of adjacent fire-barriers having complementary male or female connecting ends, said ends having each material layer directly mating an identical layer material.

15. The water-impermeable fire-barrier, as recited in claim 1, wherein said fire-barrier further comprises a retainer for each side of said water-impermeable fire-barrier that is to be attached to a building unit defining one side of an expansion-joint space.

16. The water-impermeable fire-barrier, as recited in claim 15, said water-impermeable fire-barrier is tested, rated, and certified under UL 2079 and ASTM E 1399.

17. A water-impermeable fire-barrier for use in expansion-joint spaces, comprising, a fire-barrier having a water-impermeable layer integrated within, said fire-barrier constructed from:

a layer of woven fabric heat-resistant to 2000° F.

a layer of ceramic fiber insulation blanket, a layer of high-temperature resistant water-impermeable fabric, and layer attachments, said layers of woven fabric, insulation blanket, and water-impermeable fabric fixedly attached to each other with said layer attachments forming a unitary-piece fire-barrier ready for drop-in installation into an expansion joint, said water-impermeable fabric attached to and enveloping at least one side of said fire-barrier such that said water-impermeable fabric prohibits moisture or water from coming into contact with said at least one side, providing for a water-impermeable fire-barrier for use in expansion-joint spaces, and of said fire-barrier's connection ends being formed into either a male or female shaped connecting end providing for male/female joining of adjacent fire-barriers having complementary male or female connecting ends.

18. The water-impermeable fire-barrier, as recited in claim 17, wherein said high-temperature resistant water-impermeable fabric is heat-resistant to 500° F.

19. The water-impermeable fire-barrier, as recited in claim 17, wherein said material being a silicone, a polytetrafluoroethylene, or a silicone rubber.

20. A water-impermeable fire-barrier for use in expansion-joint spaces, comprising, a fire-barrier having a water-impermeable layer integrated within, said fire-barrier comprising:

a layer of woven fabric heat-resistant to 2000° F. and a a layer of ceramic fiber insulation blanket, to which is added a layer of high-temperature resistant water-impermeable fabric comprising a high-temperature resistant water-permeable fabric treated with a material that imparts water impermeability, and layer attachments, said layers of woven fabric, insulation blanket, and water-impermeable fabric attached to each other with said layer attachments forming a unitary-piece fire-barrier ready for drop-in installation into an expansion joint, said material that imparts water impermeability being a silicone, a polytetrafluoroethylene, or a silicone rubber, said water-impermeable fabric attached to and enveloping at least one side of said fire-barrier, said water-impermeable fabric prohibiting moisture or water from entering said at least one side of said fire-barrier, providing for a water-impermeable fire-barrier for use in expansion-joint spaces, and said water-impermeable fire-barrier tested, rated, and certified under UL 2079 and ASTM E 1399.

* * * * *